US006523227B2

(12) United States Patent
Goodall

(10) Patent No.: US 6,523,227 B2
(45) Date of Patent: Feb. 25, 2003

(54) SHOULDER MOUNTED CORD RETAINING CLIP

(76) Inventor: Lance Goodall, 1600 Cortland Ter., Teaneck, NJ (US) 07666

( * ) Notice: Subject to any disclaimer, the term of this patent is extended or adjusted under 35 U.S.C. 154(b) by 0 days.

(21) Appl. No.: 09/871,792

(22) Filed: Jun. 1, 2001

(65) Prior Publication Data

US 2002/0178550 A1 Dec. 5, 2002

(51) Int. Cl.[7] ..... A44B 21/00

(52) U.S. Cl. ..... 24/3.1; 24/298; 24/306; 24/265 EC; 224/258; 224/250; 2/45

(58) Field of Search ..... 24/298, 306, 305, 24/265 CD, 265 H, 265 EC, 265 BC, 265 R, 3.1, 11 R, 72.1, 302; 224/209, 202, 642, 250; 2/2, 246, 240, 44, 45

(56) References Cited

U.S. PATENT DOCUMENTS 5,319,806 A * 6/1994 Hermann et al. ..... 2/267
5,377,391 A * 1/1995 Foster ..... 24/301
5,603,545 A * 2/1997 Benson et al. ..... 224/250
5,676,178 A * 10/1997 Ehnimb ..... 139/384 R
5,772,091 A * 6/1998 Lackner ..... 224/265
5,774,950 A * 7/1998 Stout ..... 24/298
5,852,849 A * 12/1998 Lansing et al. ..... 24/298
6,101,637 A * 8/2000 Lessard ..... 2/268
6,158,636 A * 12/2000 Latiolais ..... 224/257
6,315,426 B1 * 11/2001 Buller, Jr. ..... 362/108
6,328,189 B1 * 12/2001 Norden ..... 224/197

* cited by examiner

*Primary Examiner*—Robert J. Sandy
*Assistant Examiner*—André L. Jackson
(74) *Attorney, Agent, or Firm*—Goldstein & Lavas, P.C.

(57) ABSTRACT

A shoulder mounted cord retaining clip including a shoulder pad portion positionable on a shoulder of a user. The shoulder pad portion has a forward end and a rearward end. A forward length of line adjustably extends outwardly of the forward end of the shoulder pad portion for attaching to a segment of the cord of the electrical appliance. A rearward length of line adjustably extends outwardly of the rearward end of the shoulder pad portion for attaching to a segment of the cord of the electrical appliance.

2 Claims, 2 Drawing Sheets

SHOULDER MOUNTED CORD RETAINING CLIP

BACKGROUND OF THE INVENTION

The present invention relates to a shoulder mounted cord retaining clip and more particularly pertains to preventing a cord for an electrical appliance from becoming tangled with the appliance.

The use of cord handling devices is known in the prior art. More specifically, cord handling devices heretofore devised and utilized for the purpose of holding electrical cords are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,395,053 to Kalfas discloses a support bracket comprised of a clamp and vertical rod with a guide for holding an electrical cord. U.S. Pat. No. 1,545,017 to Smith discloses means for handling an electrical cord used with an iron. U.S. Pat. No. 5,571,228 to McMurtrie discloses a neck supported holder for a fishing rod.

While these devices fulfill their respective, particular objective and requirements, the aforementioned patents do not describe a shoulder mounted cord retaining clip for preventing a cord for an electrical appliance from becoming tangled with the appliance.

In this respect, the shoulder mounted cord retaining clip according to the present invention substantially departs from the conventional concepts and designs of the prior art, and in doing so provides an apparatus primarily developed for the purpose of preventing a cord for an electrical appliance from becoming tangled with the appliance.

Therefore, it can be appreciated that there exists a continuing need for a new and improved shoulder mounted cord retaining clip which can be used for preventing a cord for an electrical appliance from becoming tangled with the appliance. In this regard, the present invention substantially fulfills this need.

The rearward length of line 28 adjustably extends outwardly of the opening on the rearward end 18 of the shoulder pad portion 12. The rearward length of line 28 has a free outer end. The free outer end has a clip 30 secured thereto. The clip 30 is adapted for attaching to a segment 24 of the cord of the electrical appliance 26. The clips 22, 30 utilized may be similar in structure to standard alligator clips which can simply be engaged and disengaged from the cord of the electrical appliance 26. Referring to FIGS. 1, 2, and 3, the clips 22, 30 each have an open V-shaped channel which allows the electrical cord 26 to extend therethrough and be supported thereby.

SUMMARY OF THE INVENTION

In the view of the foregoing disadvantages inherent in the known types of cord handling devices now present in the prior art, the present invention provides an improved shoulder mounted cord retaining clip. As such, the general purpose of the present invention, which will be described subsequently in greater detail, is to provide a new and improved shoulder mounted cord retaining clip which has all the advantages of the prior art and none of the disadvantages.

To attain this, the present invention essentially comprises a shoulder pad portion positionable on a shoulder of a user.

The shoulder pad portion has a forward end and a rearward end each having an opening formed therein. A forward length of line adjustably extends outwardly of the opening in the forward end of the shoulder pad portion. The forward length of line has a free outer end. The free outer end has a clip secured thereto. The clip is adapted for attaching to a segment of the cord of the electrical appliance. A rearward length of line adjustably extends outwardly of the opening in the rearward end of the shoulder pad portion. The rearward length of line has a free outer end. The free outer end has a clip secured thereto. The clip is adapted for attaching to a segment of the cord of the electrical appliance.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shoulder mounted cord retaining clip which has all the advantages of the prior art cord handling devices and none of the disadvantages.

It is another object of the present invention to provide a new and improved shoulder mounted cord retaining clip which may be easily and efficiently manufactured and marketed.

It is a further object of the present invention to provide a new and improved shoulder mounted cord retaining clip which is of durable and reliable construction.

An even further object of the present invention is to provide a new and improved shoulder mounted cord retaining clip which is susceptible of a low cost of manufacture with regard to both materials and labor, and which accordingly is then susceptible of low prices of sale to the consuming public, thereby making such a shoulder mounted cord retaining clip economically available to the buying public.

Even still another object of the present invention is to provide a new and improved shoulder mounted cord retaining clip for preventing a cord for an electrical appliance from becoming tangled with the appliance.

Lastly, it is an object of the present invention to provide a new and improved shoulder mounted cord retaining clip including a shoulder pad portion positionable on a shoulder of a user. The shoulder pad portion has a forward end and a rearward end. A forward length of line adjustably extends outwardly of the forward end of the shoulder pad portion for attaching to a segment of the cord of the electrical appliance. A rearward length of line adjustably extends outwardly of the rearward end of the shoulder pad portion for attaching to a segment of the cord of the electrical appliance.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
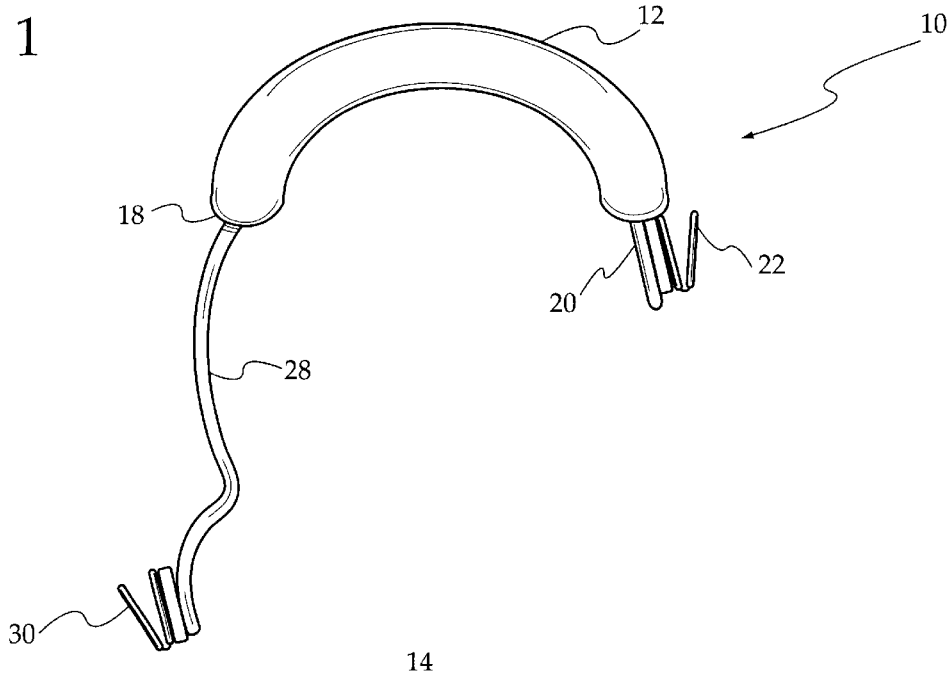
FIG. 1 is a perspective view of the preferred embodiment of the shoulder mounted cord retaining clip constructed in accordance with the principles of the present invention.
Figure 2:
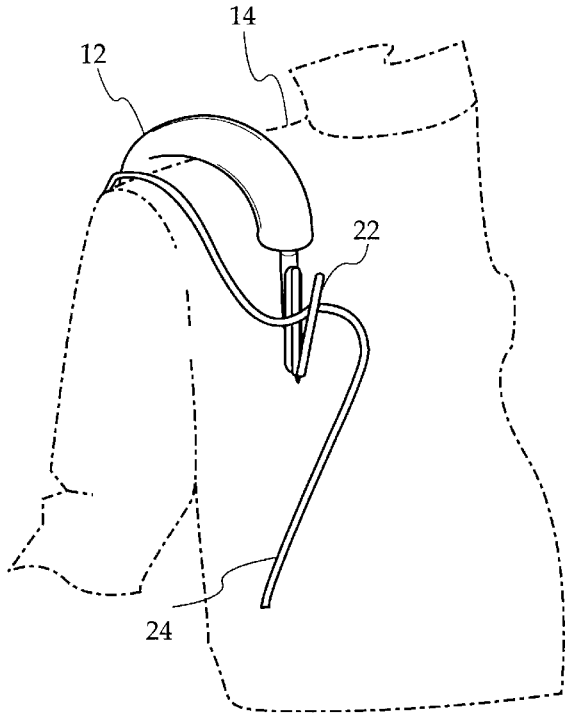
FIG. 2 is a partial front view of the present invention illustrated in use.
Figure 3:
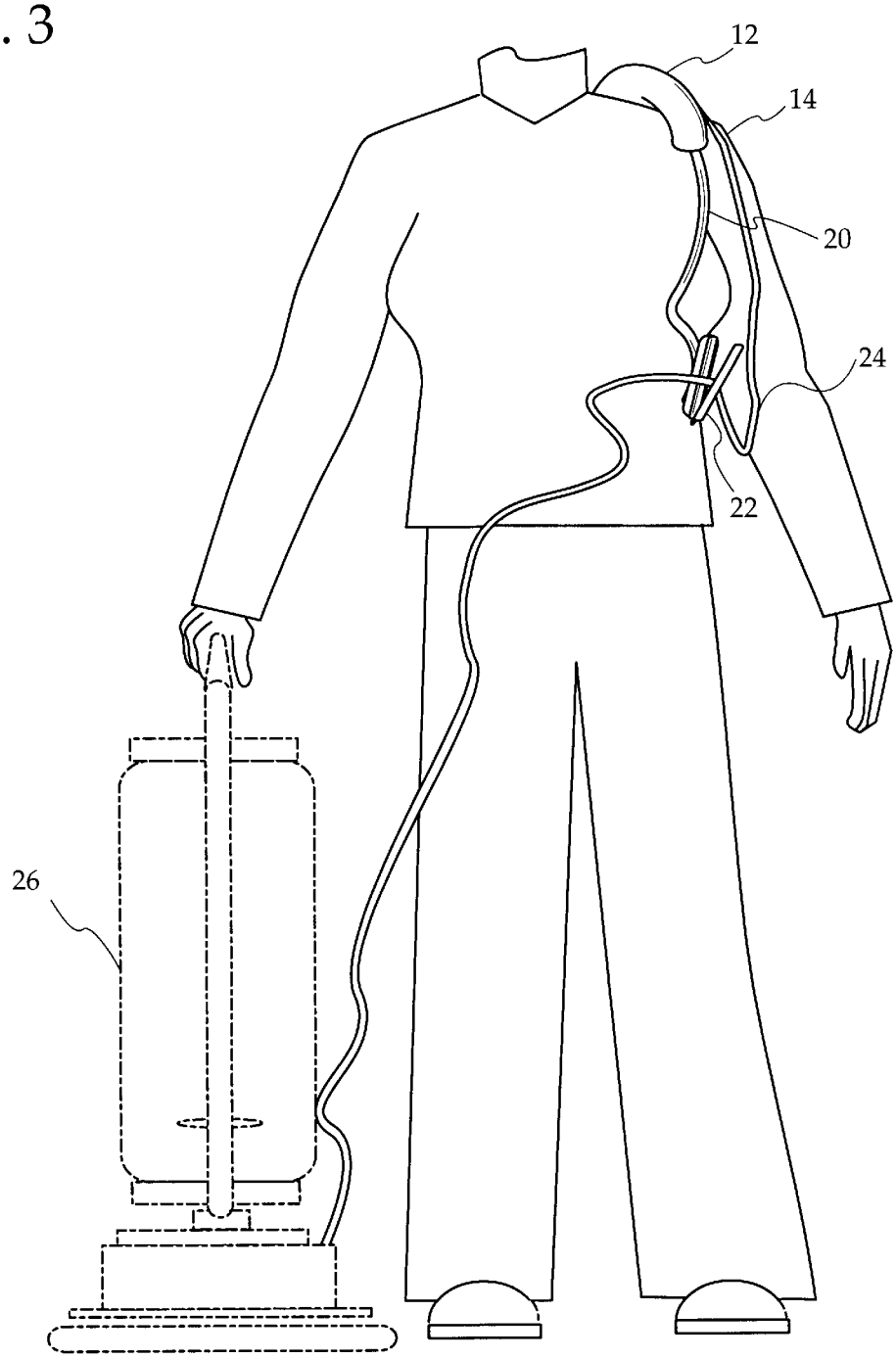
FIG. 3 is a full front view of the present invention illustrated in use.

With reference now to the drawings, and in particular, to FIGS. 1 through 3 thereof, the preferred embodiment of the new and improved shoulder mounted cord retaining clip embodying the principles and concepts of the present invention and generally designated by the reference number 10 will be described.

Specifically, it will be noted in the various figures that the device relates to a shoulder mounted cord retaining clip for preventing a cord for an electrical appliance from becoming tangled with the appliance. In its broadest context, the device consists of a shoulder pad portion, a forward length of line, and a rearward length of line. Such components are individually configured and correlated with respect to each other so as to attain the desired objective.

The shoulder pad portion 12 is positionable on a shoulder 14 of a user. The shoulder pad portion 12 has a forward end 16 and a rearward end 18 each having an opening formed therein. The shoulder pad portion 12 could also be provided with means to be temporarily engaged to the shoulder 14 of the user to prevent it from inadvertently falling off of the shoulder 14 while in use.

The forward length of line 20 adjustably extends outwardly of the opening in the forward end 16 of the shoulder pad portion 12. The forward length of line 20 has a free outer end. The free outer end has a clip 22 fixedly secured thereto. The clip 22 is adapted for attaching to a segment 24 of the cord of the electrical appliance 26.

The rearward length of line 28 adjustably extends outwardly of the opening in the rearward end 18 of the shoulder pad portion 12. The rearward length of line 28 has a free outer end. The free outer end has a clip 30 fixedly secured thereto. The clip 30 is adapted for attaching to a segment 24 of the cord of the electrical appliance 26. The clips 22,30 utilized are similar in structure to standard alligator clips which can simply be engaged and disengaged from the cord of the electrical appliance 26.

In use, the shoulder pad portion 12 is positioned on the shoulder 14 of the user. The cord is then extended over the shoulder 14. The clip 30 of the rearward length of line 28 is attached to the segment 24 of the cord. Next, the clip 22 of the forward length of line 20 is attached to the segment 24 of the cord. Thus, the cord will remain draped over the shoulder 14 while the user maneuvers the electrical appliance in the manner necessary for use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoulder mounted cord retaining clip for preventing a cord for an electrical appliance from becoming tangled with the appliance comprising, in combination:

a shoulder pad portion positionable on a shoulder of a user, the shoulder pad portion having a forward end and a rearward end each having an opening formed therein;

a forward length of line adjustably extending outwardly of the opening in the forward end of the shoulder pad portion, the forward length of line having a free outer end, the free outer end having a clip fixedly secured thereto, the clip being adapted for attaching to a segment of the cord of the electrical appliance; and a rearward length of line adjustably extending outwardly of the opening in the rearward end of the shoulder pad portion, the rearward length of line having a free outer end, the free outer end having a clip secured thereto, the clip having an open channel for allowing a segment of the cord of the electrical appliance to extend therethrough and be supported thereby.

2. A shoulder mounted cord retaining method, for use by a person having a shoulder when using an appliance having a power cord, using a device having a shoulder pad having a forward end and a rearward end and a clip located near each of the forward end and rearward end, comprising the steps of:

placing the shoulder pad on the shoulder of the user;

positioning the appliance in front of the user;

extending the power cord from the appliance over the shoulder of the user; and holding the power cord on position extending over the shoulder of the user by holding the power cord with the clips.

* * * * *